US005509332A

United States Patent [19]

Donaldson, Jr.

[11] Patent Number: 5,509,332

[45] Date of Patent: Apr. 23, 1996

[54] FRICTION CLUTCH HAND TOOL

[75] Inventor: Robert D. Donaldson, Jr., Dallas, Tex.

[73] Assignee: Three Star Enterprises, Inc., Kingsland, Ga.

[21] Appl. No.: 202,574

[22] Filed: Feb. 28, 1994

[51] Int. Cl.[6] ..... B25B 13/00

[52] U.S. Cl. ..... 81/59.1; 81/121.1; 81/124.7

[58] Field of Search ..... 81/58.2, 59.1, 81/111, 121.1, 124.7

[56] References Cited

U.S. PATENT DOCUMENTS

| | | | |
|---|---|---|---|
| 1,395,585 | 11/1921 | Kizer | 81/128 |
| 1,412,688 | 4/1922 | Layton | 81/59.1 |
| 1,482,075 | 1/1924 | Fisher | 81/128 |
| 2,460,766 | 2/1949 | Peterson | 81/128 |
| 2,896,488 | 7/1959 | Ahana | 81/53 |
| 3,621,739 | 11/1971 | Seablom | 81/59.1 |
| 4,603,606 | 8/1986 | Headen | 81/59.1 |
| 4,669,339 | 6/1987 | Cartwright | 81/59.1 |
| 4,987,802 | 1/1991 | Chern | 81/57.39 |
| 5,086,673 | 2/1992 | Korty | 81/59.1 |
| 5,277,087 | 1/1994 | Wilson et al. | 81/58.2 X |

*Primary Examiner*—James G. Smith
*Attorney, Agent, or Firm*—Fulbright & Jaworski

[57] ABSTRACT

A friction clutch hand tool in the style of a socket wrench for tightening and loosening common mechanical fasteners. Socket may be received from either side into a cylindrical opening through the wrench head. Once received inside the head, socket is gripped by rollers held captive within notches provided in cylindrical wall of opening in wrench head. Rollers grip outside surface of socket directly. Rotation of head relative to socket causes rollers to roll up ramps out of notches and wedge tight against socket, thereby simultaneously imparting torsion to fastener while clamping socket down on fastener. Socket may be assembled around fastener from multiple interlocking pieces. Socket may also be hollow.

2 Claims, 3 Drawing Sheets

FRICTION CLUTCH HAND TOOL

INTRODUCTION AND BACKGROUND OF THE INVENTION

This invention relates to a friction clutch hand tool in the style of a socket wrench for use in tightening and loosening conventional mechanical fasteners. While the preferred embodiment herein is directed to use of the tool on a common hexagonal fastener, there is no limitation on the shape of the fastener that this tool can be applied to, so long as the internal shape of the socket matches that of the fastener. The only limitation on the application of this tool is that the fastener must have an outer surface that is physically susceptible to receiving a female socket to tighten or loosen it.

Friction clutch socket wrenches are generally well known in the art. See, e.g., Korty, U.S. Pat. No. 5,086,673; Cartwright, U.S. Pat. No. 4,669,339; Seablom, U.S. Pat. No. 3,621,739; and Pratt, U.S. Pat. No. 2,469,572. In order to harness a friction force, however, these previous inventions have utilized multiple roller and spring systems that bear against pins and stops strategically located in a complex wrench assembly. Previous inventions have also consistently brought the friction force to bear on a member that is encased within the wrench assembly. A conventional socket is then connected to this member by means of a traditional square drive.

The present invention improves on the prior art in several respects. It consists of a wrench driving a socket that is split into two or more pieces along its cylindrical axis. The wrench slides over the outside circumference of the assembled socket. Its improved design uses the torque applied to the wrench by the user to provide circumferential friction directly to the outside surface of the socket. A traditional square drive connection to the socket thus becomes unnecessary. The split socket provides improved access to fasteners in locations that would otherwise be hard to reach. The split socket also provides improved grip on the fastener when used in conjunction with the wrench, since the wrench tends to clamp and compress the socket over the fastener when in use. The tool as a whole operates on a fastener to which a wire or cable is attached without first having to disconnect that wire or cable. The simple design of the tool as a whole facilitates manufacture. The novel design of the wrench obviates the need for a mechanical direction selector to set whether torsion will be applied to the socket in a clockwise or counterclockwise direction. Instead, the wrench is capable of receiving a socket from either of two opposite sides, and the side from which the socket is received dictates the selected direction of torsion.

BRIEF SUMMARY OF THE INVENTION

One object of the present invention is to provide improved access to fasteners found in awkward or congested locations. As noted, the invention provides a socket that is split along its cylindrical axis into two or more interlocking pieces. This split-socket feature is apparently unknown in the prior art. Being in two or more pieces, the socket provides dramatically improved access to a fastener. Instead of placing a traditional socket over the end of a component held by the fastener, the user assembles the pieces of this socket around the fastener. Only approximately ¾" clearance is then required at the end of the component to bring the wrench in and slide it over the interlocked pieces of the socket. The socket is ideally split into equal and identical pieces so that the pieces are interchangeable in relative position when assembled around a fastener. This feature will facilitate manufacture and operation. The pieces of the socket may also be magnetically charged so that when brought together over a fastener, they will remain there by themselves while the wrench is slid over them.

Another object of the invention is to improve the grip on a fastener by a socket. This feature will increase the potential life of the fastener and enhance the personal safety of the user of the wrench. Traditional sockets tend to "round off" the flat faces of a fastener because the fastener's resistance to the torque being applied causes the end of the socket to enlarge marginally in diameter. This effect in turn causes the socket to distort the shape of the fastener, especially at the corners where the flat faces of the fastener meet. Eventually there is play between the shape of the socket and the shape of the fastener, play that causes the socket to "slide over" the fastener as torque is applied. This type of failure between the socket and fastener will usually shorten the effective life of the fastener. Further, because failure can occur catastrophically and while the user is applying considerable torque, the user can be exposed to injury. The frequency of this type of industrial accident is well documented.

This invention will counteract both of these effects. As torque is applied, the wrench constricts diametric enlargement of the socket as the needle rollers within the wrench bear directly upon the socket to gain circumferential friction. Further, the split in the socket provides marginal displacement of its overall shape in response to the radial forces placed upon it by the rollers in the wrench. This in turn tends to conform the shape of the socket to the shape of the fastener and take up any play existing between the two.

Another object of this invention is to provide a hand tool capable of installing and removing screw-in components to which wires or cables are attached without first detaching the wire or cable from the component. This invention provides this feature by being hollow along the cylindrical axis of the socket. The socket is first placed over the component by attaching each half of the socket from opposite sides. The wire or cable attached to the component is then threaded through the hole in the wrench. The wrench can then be placed over the socket and the fastener rotated without distressing the wire or cable.

A friction clutch socket wrench with this hollow axis feature is apparently unknown in the prior art. The feature also serves a long-felt but unsolved need in the automobile industry to install or remove components such as oxygen sensors on exhaust manifolds. These components are almost universally very awkward to access. Further, such components typically have a wire permanently attached by a special metallurgic process, which connection, if damaged, renders the component completely unserviceable. Specialized one-piece sockets are known in the industry that provide notches or grooves in their inside walls to accommodate the wires. Such sockets are not effective because they do not solve the access problem, and because the notches or grooves in the socket rotate with the socket as it is turned, causing distress to the wire and its connection to the component. The present invention solves immediately both the access problem and the wire connection protection problem presented in the installation and removal of these components.

Another object of this invention is to provide a simplified and improved design of a wrench that will apply circumferential friction directly to the outside surface of a cylindrical socket to give both clockwise and counterclockwise torsion. The invention provides a wrench that simply slides over the socket. A plurality of needle rollers bear directly upon the outside circumferential surface of the socket and provide friction directly to that outside surface. When torque is applied to the wrench, these rollers roll synchronously up ramps to impose a circumferential friction on the socket that translates into torsion on the fastener. This method of applying friction directly to the outside surface of a socket through rollers synchronously travelling up identical ramps is apparently unknown in the art.

Further, the prior an consistently discloses mechanically complicated devices with many intricate cooperating parts. This makes them difficult to manufacture and maintain, as well as potentially unreliable. In contrast, this invention discloses a plurality of simple needle rollers held captive in recesses in the wrench by an equal number of springs and one cylindrical roller cage. The advantages of this simple design to ease of manufacture and to potential reliability are self evident.

Further, all friction clutch wrenches in the prior an disclose some type of mechanism to reverse the direction of operation manually. The present invention provides a wrench that is symmetrical about the plane of its opening, and is thus capable of receiving a socket from either side. This provides for clockwise torsion (and corresponding counterclockwise free revolution) when a socket is received from one side, and vice versa when a socket is received from the other side. This feature obviates the need for a manual switch or selector mechanism to reverse the direction of operation of the wrench. A friction clutch socket wrench that reverses direction of operation simply by receiving a socket from the other side is apparently unknown in the art. This feature also makes the wrench immediately more efficient to manufacture and use.

These and other objects of the present invention will be apparent to those skilled in this art from the detailed description of a preferred embodiment of the invention set forth below.

BRIEF DESCRIPTION OF THE DRAWINGS

The invention will be further described in connection with the accompanying drawings, in which.

DETAILED DESCRIPTION OF THE INVENTION

As summarized above, this invention is directed to a friction clutch hand tool that tightens or loosens a fastener in the style of a socket wrench. The tool provides a wrench that imparts torsion to the fastener through direct friction grip of the outside cylindrical surface of a multipieced socket assembled over the fastener. The tool provides, among other benefits, improved access to hidden fasteners, improved grip on the fastener when imparting torsion, and the ability to tighten or loosen a fastener to which a wire is attached without first having to remove the wire. These features will in particular address a long-felt but unsolved need to install or remove oxygen sensors located on the exhaust manifolds of modern automobiles without removing or damaging the wire metallurgically connected to these oxygen sensors.

Figure 1:
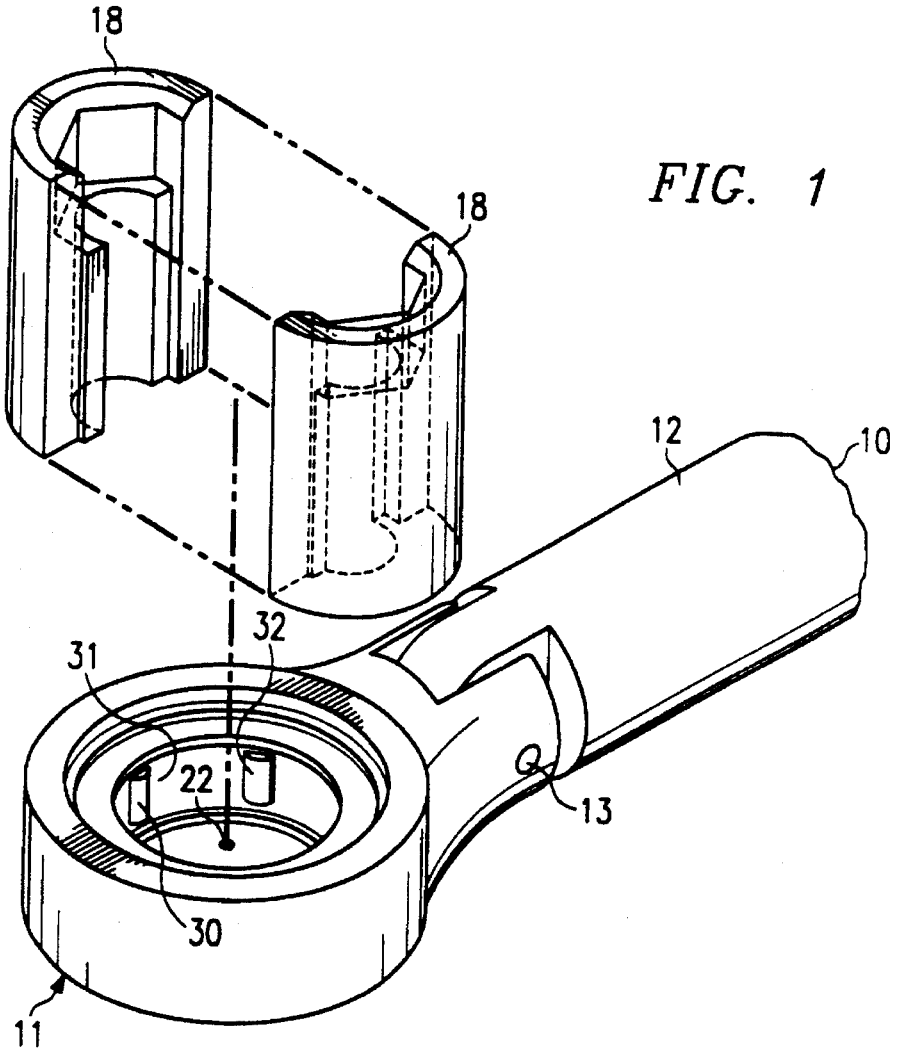
FIG. 1 is a perspective view of the tool showing the head of the wrench in position to receive the split socket. The split socket is shown exploded to aid understanding of its method of assembly prior to receipt by the wrench.
Figure 2:
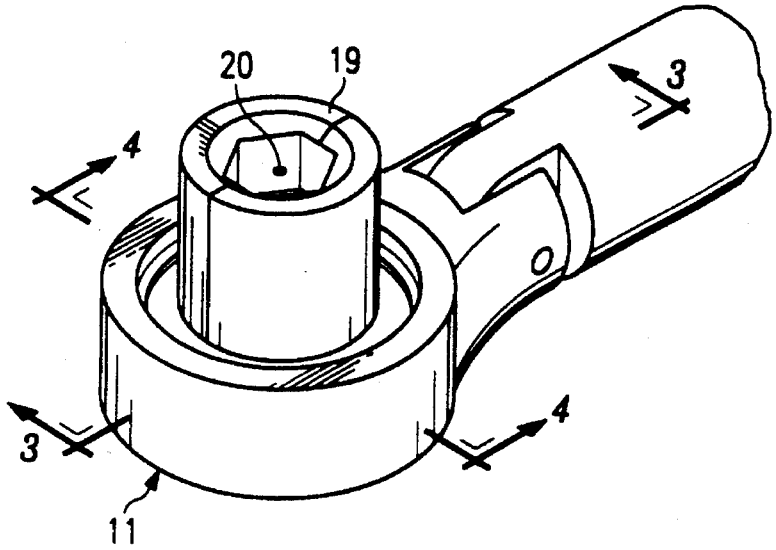
FIG. 2 is a similar perspective view of the tool as shown in FIG. 1, except that FIG. 2 shows the assembled socket received by the wrench.

The invention is shown in perspective in FIG. 1 and FIG. 2. Wrench 10 has a head 11 connected to a handle 12 by a hinge pin 13. The location of hinge pin 13 is such to provide rotation of handle 12 about head 11 in a plane perpendicular to the plane of normal operation of the wrench. As shown in more detail in FIG. 3 and FIG. 5, handle 12 also contains a hemispherical detent 14, while head 11 contains a cylindrical recess 15. A helical detent spring 16 and a steel detent ball 17 are received into cylindrical recess 15. Cylindrical recess 15 and hemispherical recess 14 are then located in the connection of head 11 to handle 12 so that detent ball 17 is held captive in hemispherical detent 14 by detent spring 16 when handle 12 is in normal operating position about head 11. This arrangement allows handle 12 to "click" into normal operating position, and remain there until specifically required to be operated from a different angle.

Figure 3:
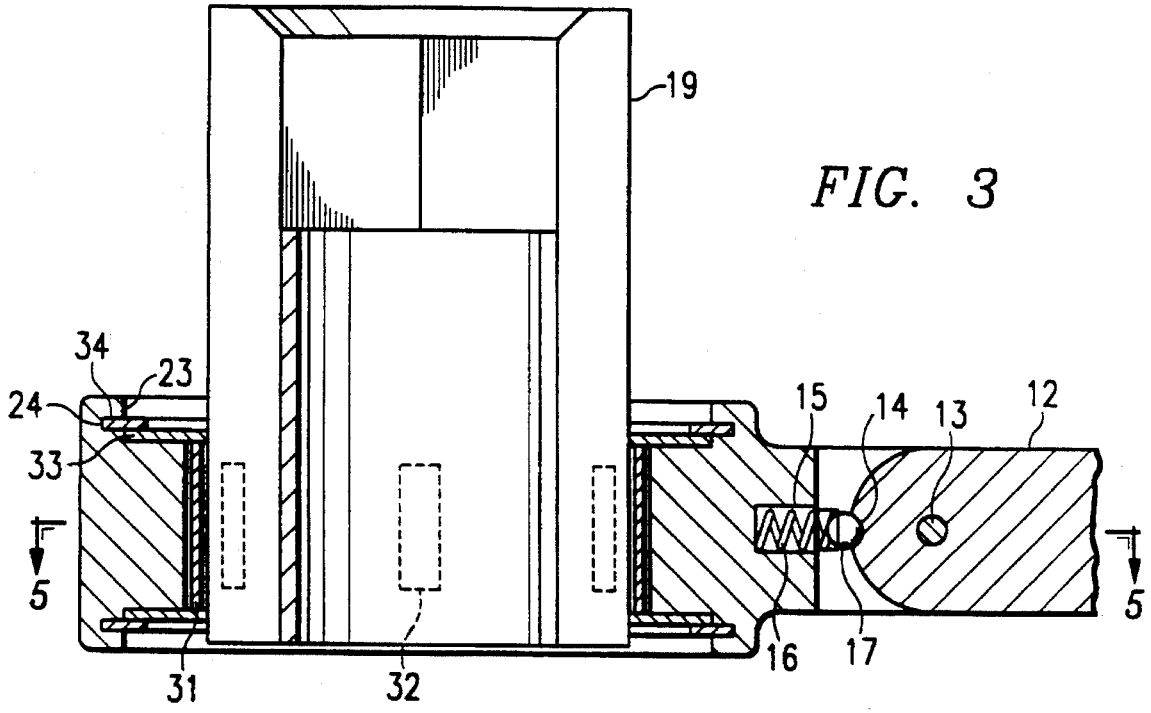
FIG. 3 is a section taken as shown in FIG. 2, showing various internal components of the head of the wrench, and the method of attaching the wrench handle to the head.
Figure 4:
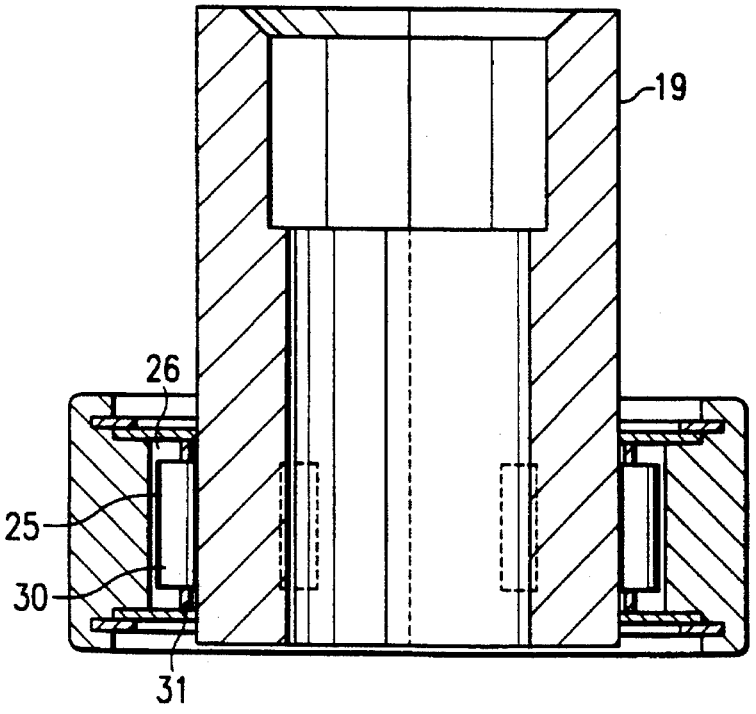
FIG. 4 is another section taken as shown on FIG. 2. This section also shows various internal components of the head of the wrench.

FIG. 1 also shows a plurality (preferably 2) of identical socket pieces 18 that interlock to provide a hollow cylindrical socket 19. Either or both ends of assembled socket 19 provide a drive recess 20 to match the outside shape (usually hexagonal) of a mechanical fastener. FIG. 2, FIG. 3 and FIG. 4 show socket 19 assembled to provide a single hexagonal drive recess 20 at one end. As shown in section on FIG. 5, socket pieces 18 contain uniform locating lugs 21 at their points of interlock to aid assembly.

Figure 5:
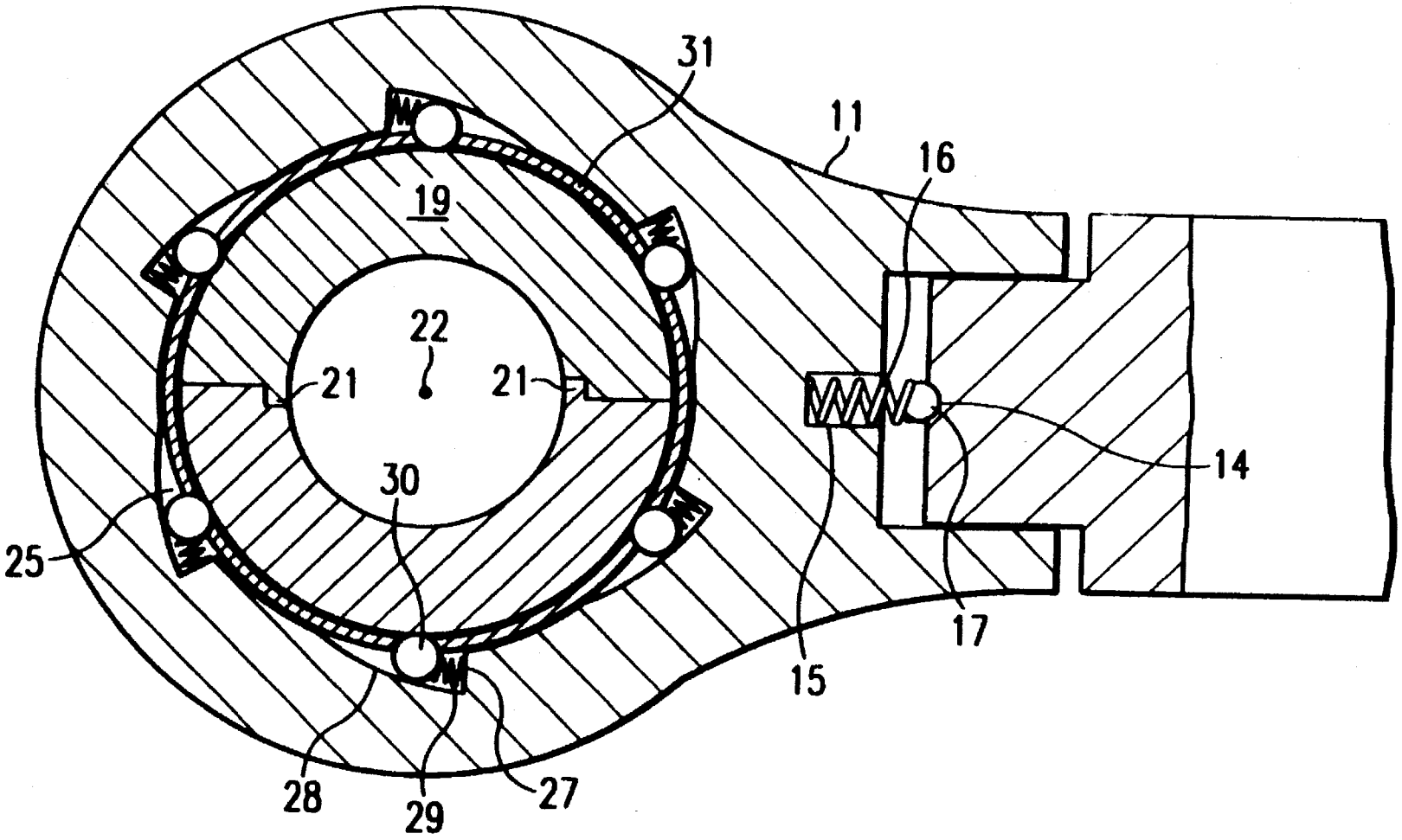
FIG. 5 is a section taken as shown in FIG. 3, showing the arrangement of the internal components of the head of the wrench in plan view.

Wrench head 11 contains a cylindrical opening 22. As shown in section on FIG. 3 and FIG. 4, the diameter of opening 22 is reamed out at both ends to give identical and slightly larger cylindrical recesses 23 at both entrances to opening 22. Recesses 23 contain grooves 24 in their circumferences. FIG. 5 shows the inside surface of opening 22 in section, wherein it can be seen that opening 22 also provides a plurality (preferably 6) of identical notches 25 spaced equally around its circumference. Returning to FIG. 3 and FIG. 4., notches 25 can be seen to extend along the inside surface of opening 22 in a direction parallel to the cylindrical axis of opening 22. Notches 25 do not extend all the way through opening 22, however, leaving portions of unnotched circumference 26 at both ends of opening 22. FIG. 5 shows the cross-sections of notches 25 as identical, providing a sharp cutout 27 into the notch 25 on one side and a continuous grade ramp 28 on the other side. The cross-sections of notches 25 are oriented so that ramps 28 elevate in the same direction around the circumference of opening 22.

As further shown by FIG. 5, identical roller wafer springs 29 and identical solid cylindrical rollers 30 are received uniformly into each notch 25 and are held captive therein by a single cylindrical roller cage 31. Best seen on FIG. 1, roller cage 31 contains identical rectangular holes 32 of a size and location to allow each roller 30 to protrude partially but uniformly through roller cage 31 when sitting fully within its respective notch 25. As shown on FIG. 3 and FIG. 4, roller cage 31 is then held in position by thrust washers 33 located within recesses 23 at each entrance to opening 22. Thrust washers 33 are in turn held in position by retainer snap rings 34 located over thrust washers 33 and within grooves 24 in recesses 23.

The outside diameter of assembled socket 19 is chosen so that when received inside roller cage 31, as shown on FIG. 2, the outside cylindrical surface of socket 19 is in uniform close proximity to rollers 30, as shown on FIG. 4 and FIG. 5. To operate the invention, socket pieces 18 are assembled to form socket 19 located over a fastener. Wrench head 11 is slipped over the assembly by receiving socket 19 into roller cage 31. FIG. 5 shows that as torque is applied about socket 19, rollers 30 begin to roll uniformly and synchronously out of notches 25 and up ramps 28. As rollers 30 continue to roll up ramps 28, the diametric pitch of rollers 30 constricts uniformly, causing rollers 30 to synchronously wedge tight between ramps 28 and the outside surface of socket 19. Once wedged tight, rollers 30 are then in friction with the outside surface of socket 19 and thereby impart torsion to socket 19. The forced diametric constriction of the circular pitch of rollers 30 also results in a uniform radial compression that clamps socket 19 tighter over the fastener as torque to the wrench is increased.

Releasing socket 19 is simply a matter of reversing the direction of rotation of handle 12. Referring again to FIG. 5, rollers 30 roll back down ramps 28 and into notches 25. Once back in notches 25, rollers 30 then allow free reverse rotation until torque is again applied in the original direction to bring rollers 30 back up ramps 28.

In order to reverse the direction of operation of the invention, assembled socket 19 is received into roller cage 31 from the opposite side of head 11. Ramps 28 are then oriented to constrict the diametric pitch of rollers 30 when torque is applied to handle 12 in the reverse direction.

The invention has been shown, described and illustrated in substantial detail with reference to a presently preferred embodiment. However, it will be understood by those skilled in the art that changes and modifications may be made without departing from the spirit and scope of the invention which is defined by the claims set forth hereunder.

I claim:

1. A split socket, comprising:

a socket, the socket being of substantially cylindrical shape, the cylindrical shape having a substantially smooth outer surface, the socket split longitudinally into a plurality of individual interlocking socket pieces, the socket, when assembled, also having a drive recess in at least one end, the interlocking socket pieces being magnetically charged, the interlocking socket pieces also having a plurality of locating lug means, each locating lug means positioned at a point of interlock;

whereby access to a fastener by the socket may be improved by assembling the interlocking socket pieces around the fastener.

2. A split socket, comprising:

a socket, the socket being of substantially cylindrical shape, the cylindrical shape having a substantially smooth outer surface;

the socket also split longitudinally into a plurality of individual interlocking socket pieces, the interlocking socket pieces magnetically charged to enhance hands-free assembly thereof; and the socket, when assembled, also having a drive recess in at least one end;

whereby access to a fastener by the socket is improved by assembling the interlocking socket pieces around the fastener.

* * * * *